US010155130B2

(12) United States Patent
Piksa

(10) Patent No.: US 10,155,130 B2
(45) Date of Patent: Dec. 18, 2018

(54) ADJUSTABLE, ASTABLE SEAT FOR INCREASING THE USE OF A USER'S CORE MUSCLES WHILE EXERCISING

(71) Applicant: Thane IP Limited, London (GB)

(72) Inventor: Jelenko Piksa, Toronto (CA)

(73) Assignee: Thane IP Limited, London (GB)

( * ) Notice: Subject to any disclaimer, the term of this patent is extended or adjusted under 35 U.S.C. 154(b) by 14 days.

(21) Appl. No.: 15/350,023

(22) Filed: Nov. 12, 2016

(65) Prior Publication Data

US 2017/0136294 A1 May 18, 2017

Related U.S. Application Data

(60) Provisional application No. 62/255,489, filed on Nov. 15, 2015.

(51) Int. Cl.

| | |
|---|---|
| ***A63B 21/00*** | (2006.01) |
| ***A63B 22/16*** | (2006.01) |
| ***A47C 7/02*** | (2006.01) |
| ***A63B 22/18*** | (2006.01) |

(Continued)

(52) U.S. Cl.

CPC ..... *A63B 21/4039* (2015.10); *A47C 7/029* (2018.08); *A63B 22/16* (2013.01); *A63B 22/18* (2013.01); *A63B 23/02* (2013.01); *A63B 22/0087* (2013.01); *A63B 2208/0233* (2013.01);

(Continued)

(58) Field of Classification Search

CPC ..... A47C 9/002; A47C 7/022; A47C 7/021; A61H 1/0292; A61H 1/005; A61H 2203/0431; A61H 2203/0149; A61H 2203/0103; A63B 21/4039;

(Continued)

(56) References Cited

U.S. PATENT DOCUMENTS

| | | | |
|---|---|---|---|
| 6,422,983 | B1 | 7/2002 | Weck |
| 6,616,238 | B1 | 9/2003 | Guery-Strahm |
| 6,719,676 | B1 | 4/2004 | Hsu |

(Continued)

OTHER PUBLICATIONS

"Fitball Seating Disc" product, retrieved from Internet at https://www.relaxtheback.com/fitball-seating-disc. html on Nov. 9, 2016.

(Continued)

*Primary Examiner* — Megan Anderson

(74) *Attorney, Agent, or Firm* — Intellectual Property Law Offices of Joel Voelzke, APC

(57) ABSTRACT

A seating device for increasing use of a user's core muscles includes an adjustable air-filled bladder having generally flat top and bottom surfaces, and a significantly stiffer but resilient foam cover that fits over and matingly engages to the bladder. The cover is contoured, having both a central groove or recess that partially receives and accommodate male genitalia, and a raised ridge toward the front of the device to help keep the user properly positioned on the cover. The fluid-filled bladder is astable or wobbly, requiring the user to use his core muscles to maintain an upright, seated position, while the cover provides a comfortable contoured seat. The device can be used with an exercise device in which the user sits on the device, including on an abdominal exercise device, thus increasing both the abdomen strengthening action of the exercise as well as providing increased comfort for the user.

19 Claims, 3 Drawing Sheets

(51) Int. Cl.
*A63B 23/02* (2006.01)
*A63B 22/00* (2006.01)

(52) U.S. Cl.
CPC ..... *A63B 2209/10* (2013.01); *A63B 2225/62* (2013.01)

(58) Field of Classification Search
CPC ..... A63B 21/00178; A63B 21/4027; A63B 21/4029; A63B 2209/10; A63B 22/16; A63B 22/18
See application file for complete search history.

(56) References Cited

U.S. PATENT DOCUMENTS 7,373,678 B2 * 5/2008 Hetzel ..... A47C 7/022 29/91.1
8,056,976 B1 * 11/2011 Polk ..... A47C 3/029 297/258.1
8,926,483 B1 * 1/2015 Holloway ..... A63B 26/003 297/271.5
9,079,067 B2 7/2015 Huber et al.
9,125,493 B2 * 9/2015 Siekman ..... A47C 7/021
9,642,469 B2 * 5/2017 Savicki ..... A47C 27/081
2002/0108179 A1 * 8/2002 Kiser ..... A47C 7/021 5/654
2002/0111389 A1 * 8/2002 Chaudhary ..... C08J 9/0061 521/139
2002/0175553 A1 * 11/2002 Steifensand ..... A47C 3/00 297/452.22
2008/0207410 A1 * 8/2008 Tacconi ..... A63B 22/18 482/123
2013/0005550 A1 * 1/2013 Nagy ..... A47C 9/002 482/146
2013/0187356 A1 * 7/2013 Hazeleger ..... A61G 5/10 280/250.1

OTHER PUBLICATIONS

"Air Stability Wobble Cushion" product, retrieved from Internet at https://www.amazon.com/Stability-Cushion-Diameter-Balance-Included/dp/B007LX6MPG on Nov. 9, 2016.
Gofit "Core Stability Disk" product, retrieved from Internet at https://www.gofit.net/index.php/core-stability-disk.html on Nov. 9, 2016.
Theraband "Stability Disk" product, retrieved from Internet at http://www.thera-band.com/store/products.php?ProductID=56 on Nov. 9, 2016.
"Forté Contour XFM Men's Saddle" product, retrieved from Internet at http://www.performancebike.com/bikes/Product_10052_10551_1166780_-1_ on Nov. 9, 2016.
"Extra Large Contour Exercise Bike Seat" product, retrieved from Internet at http://www.exercisebikeseats.com/bench-seat-exercise.htm on Nov. 9, 2016.

* cited by examiner

ADJUSTABLE, ASTABLE SEAT FOR INCREASING THE USE OF A USER'S CORE MUSCLES WHILE EXERCISING

CROSS-REFERENCE TO RELATED APPLICATIONS

This application claims priority from U.S. Provisional Patent Application No. 62/255,489 filed Nov. 15, 2016, which is incorporated by reference as if set forth fully herein.

BACKGROUND OF THE INVENTION

1. Field of the Invention

This invention relates to the field of exercise equipment. More particularly, this invention relates to the field of an adjustable, astable seat for increasing the use of a user's core muscles while exercising.

2. Description of Related Art

Numerous abdominal exercise devices have been proposed and/or sold. A device called the Ab Doer Twist® and generally shown in U.S. Design Pat. No. D639,873, owned by the assignee of the present application, includes a chair and a handlebar type device attached to a flexing, torsional rod, for use in exercising the abdominal muscles. Other abdominal exercise machines or devices are disclosed variously in U.S. Pat. No. 9,168,416 to Ho et al.; U.S. Pat. No. 9,005,089 to Huang; U.S. Pat. No. 8,986,179 to Cares; and U.S. Pat. No. 8,226,533 to Wessels et al.

Additionally, various inflated seating devices variously called stability disks are used to increase a user's core muscles while sitting.

SUMMARY OF THE INVENTION

The present invention is of a seating device that makes a user seated thereon less stable, thus requiring the user to employ his core muscles more in order to maintain an upright, seated position. The result is a more effective core muscle workout. The device can be matingly engaged to an exercise machine such that the user uses his core muscles more while using the exercise machine, whether that exercise machine is an abdominal exercise device such as the Ab Doer Twist® machine or other type of machine.

In an exemplary embodiment the seating device includes a fluid-filled bladder such as an inflatable air bladder, the bladder having a generally flat top and a generally flat bottom, and a cover that is substantially stiffer than the bladder and that matingly engages the bladder. The cover comprises a stiff resilient material for added comfort. In the exemplary embodiment, the cover comprises a stiff foam material in order to minimize the pressure on the user's soft tissue such as skin, fat, and muscles, and on the user's bones. The cover is preferably contoured for additional seating comfort. In the embodiment, the cover has a recess along a center line, the recess extending from a rear edge of the cover to at least the center of the cover. The recess accommodates and partially receives the user's male genitalia, and also reduces pressure on the pelvic area and on the prostate in men. A raised, rounded ridge near the front of the device for positioning between the legs of the user helps to secure the user's hamstring and torso and to more securely position and hold the user on the cover.

In the exemplary embodiment, the cover matingly engages the bladder by both a downwardly extending peripheral lip of the cover that extends downward at least partially around the periphery of the bladder thus holding the cover securely on the bladder so that the cover and the user seated thereon do not slip off the bladder, and by a hook-and-pile fastener such as Velcro®.

The bladder can be filled with any fluid. In the exemplary embodiment, the bladder is an air-filled bladder, and has an air valve so that the user can adjust the pressure in the bladder for the weight of the user, and to a desired stiffness. The greater the air pressure, the stiffer and more rounded on its top surface will be the bladder, and the more the user is required to use his core muscles to maintain his balance while seated on the device. The less the air pressure, the softer and flatter the bladder will be, and the less the user will be required to use his core muscles to maintain his balance.

Exemplary embodiments of the invention will be further described below with reference to the drawings, in which like numbers refer to like parts. The drawing figures might not be to scale, and certain components may be shown in generalized or schematic form and identified by commercial designations in the interest of clarity and conciseness.

DETAILED DESCRIPTION OF THE PREFERRED EMBODIMENTS

Figure 1:
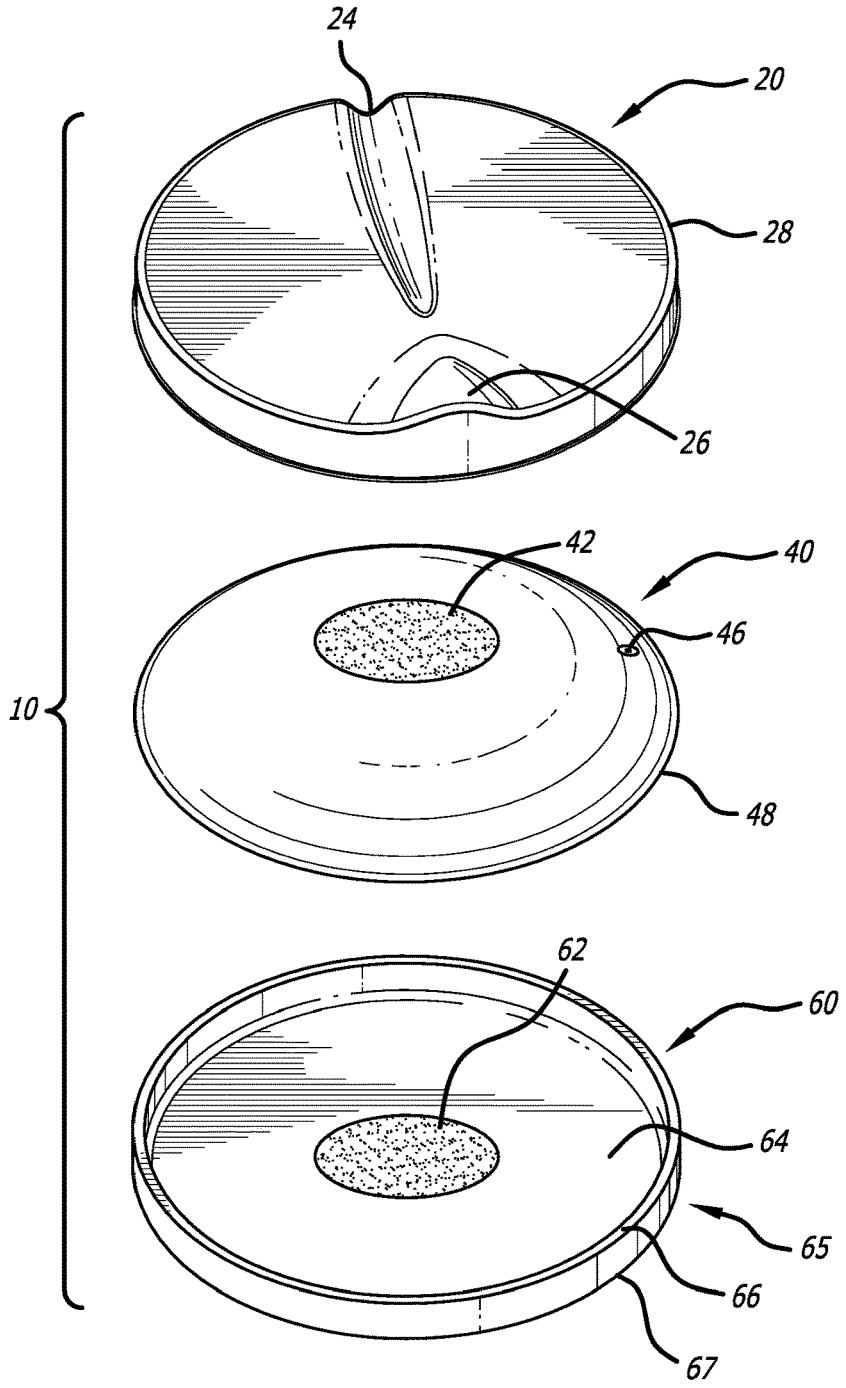
FIG. 1 is a top oblique exploded view of the seating device according to an exemplary embodiment in which the device is a 3-piece device.
Figure 2:
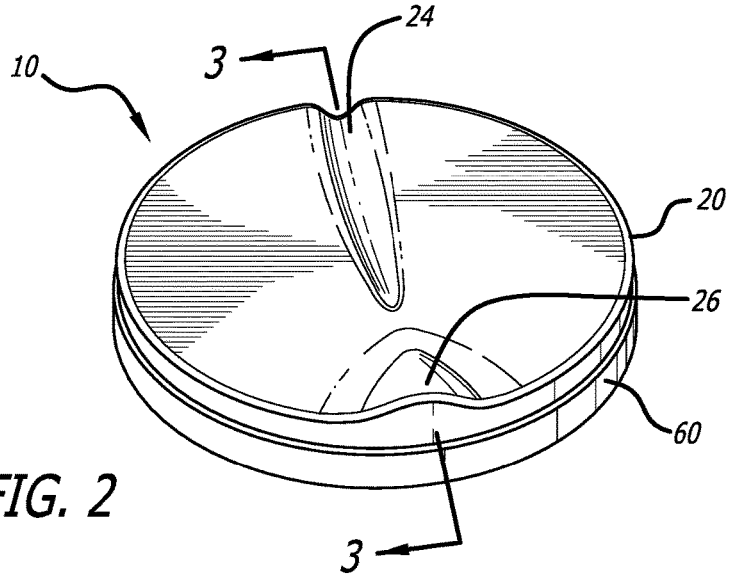
FIG. 2 is a top oblique view of the seating device of FIG. 1, assembled for use.
Figure 3:
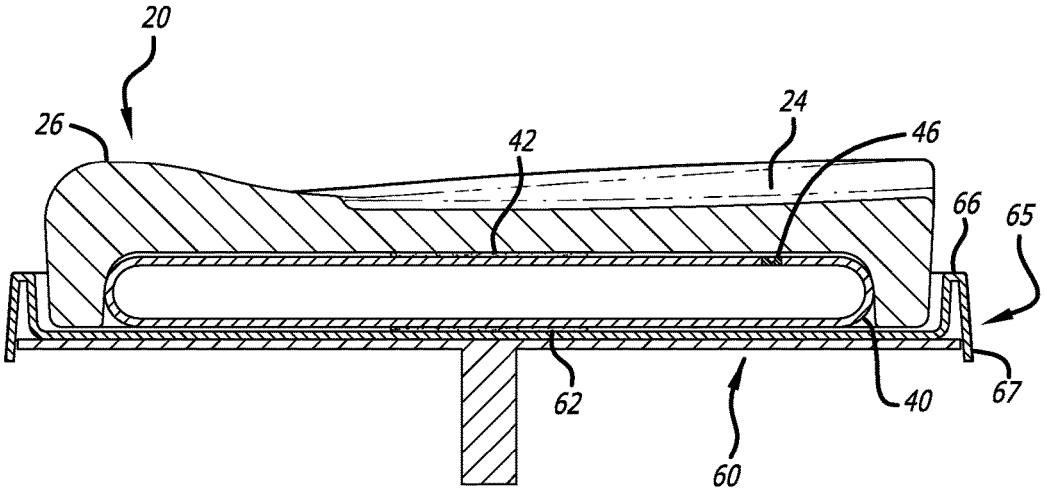
FIG. 3 is a side cutaway view of the seating device of FIG. 2.

Referring to FIGS. 1-3, seating device 10 includes a bottom tray 60, an air bladder or resilient foam disk 40, and a relatively stiff yet resilient foam cover 20.

Bottom tray 60 includes a major surface area 64 which can be generally flat, and a peripheral lip 65 that has both an upwardly extending upper portion 66 and a downwardly extending lower portion 67. As seen in FIG. 3, the lower portion 67 can securely position the device on the flat seat of an existing exercise device. Upper portion 66 of peripheral lip 65 holds bladder 40 and cover 20 within bottom tray 60.

Bladder 40 may be a fluid-containing bladder, and more preferably an air-filled bladder that has an air valve 46 so that a user can adjust the air pressure inside the bladder, and thus can adjust the stiffness of the seating device. Air valve 46 may be a inflation valve of the type commonly used on basketballs and footballs, with which an inflation needle is used for inflation or deflation. Alternatively, instead of being inflated with air, bladder 40 may be filled with a different fluid such as water, or may be a disc made of a foam material.

Bladder 40 is filled to a pressure such that when the cover is positioned on the bladder with the peripheral lip 28 extending over peripheral edge 48 of the bladder and the user is seated on the cover, the bladder provides a degree of instability to the user seated thereon such that the user must increase use of his core muscles in order to maintain an upright seated position. The air pressure in bladder 40 is preferably also sufficient to keep the user's posterior approximately 15-cm off the exercise machine seat or other supporting surface, and thus keeps the user from "bottoming out" on the seat.

Bladder 40 may be generally flat on both its top and bottom.

Cover 20 is preferably made of a stiff foam material. Cover 20 has a downwardly extending peripheral lip 28 that extends at least partway down an outer edge of the bladder. Lip 28 thus holds bladder 40 to cover 20 while cover 20 is located on bladder 40. Cover 20 thus matingly engages bladder 40. To perform this function, peripheral lip 28 extends at least partly down an outer of the bladder. Cover 20 further has a recess or groove 24 along a central line of cover 20. Recess 24 is preferably greater than ½" deep, and preferably extends from a rear end of cover 20 to at least a center of cover 20, and preferably extends at least slightly beyond the center toward the front of cover 20. Recess 24 accommodates and partially receives a male user's genitalia for comfort. The recess also reduces pressure on the pelvic area and on the prostate in men for increased comfort. Cover 20 also preferably has a raised, rounded ridge 26 near the front of the cover for positioning between the legs of the user helps to secure the user's hamstring and torso, and more securely position and hold the user on the cover. Recess 24 and raised ridge 26 are thus located generally along a common line that extends from a rear of device 10 to the front thereof.

The cover preferably has an Asker C durometer hardness of 20-50, and more preferably 30-40. An Asker C durometer hardness of 30-40 generally corresponds to a Shore A durometer hardness of approximately 12-20.

Preferably, means are provided for holding the pieces of the device together while in use. In the exemplary embodiments, the holding or fastening means include the upwardly extending raised lip on the bottom tray 60, as well as the downwardly extending lip on cover 20. Additionally, the cover, the bladder, and the tray can be provided with releasable fastening means such as hook-and-pile fasteners such as Velcro® for holding the pieces together. In FIG. 1 Velcro® patches 42, 62 can be seen on the top surfaces of bladder 40 and tray 60, respectively.

Bladder 40 is preferably though not necessary round and disc-shaped, and less than 18 inches in diameter, so that the device can be easily placed upon and used on a seated-position exercise device such as the Ab Doer Twist®. Preferably, the device can be releasably fastened to the bench of the exercise device, such as the bottom tray 60 being affixed to the machine by Velcro®, or by the tray having a bottom contour such as downwardly extending lip portion 67 that receives and holds the existing seat of the machine, or even by the bottom tray 60 being bolted to the exercise machine. In any of these ways and other known ways, device 10 thus can matingly engage the existing seat on an existing exercise machine.

Figure 4:
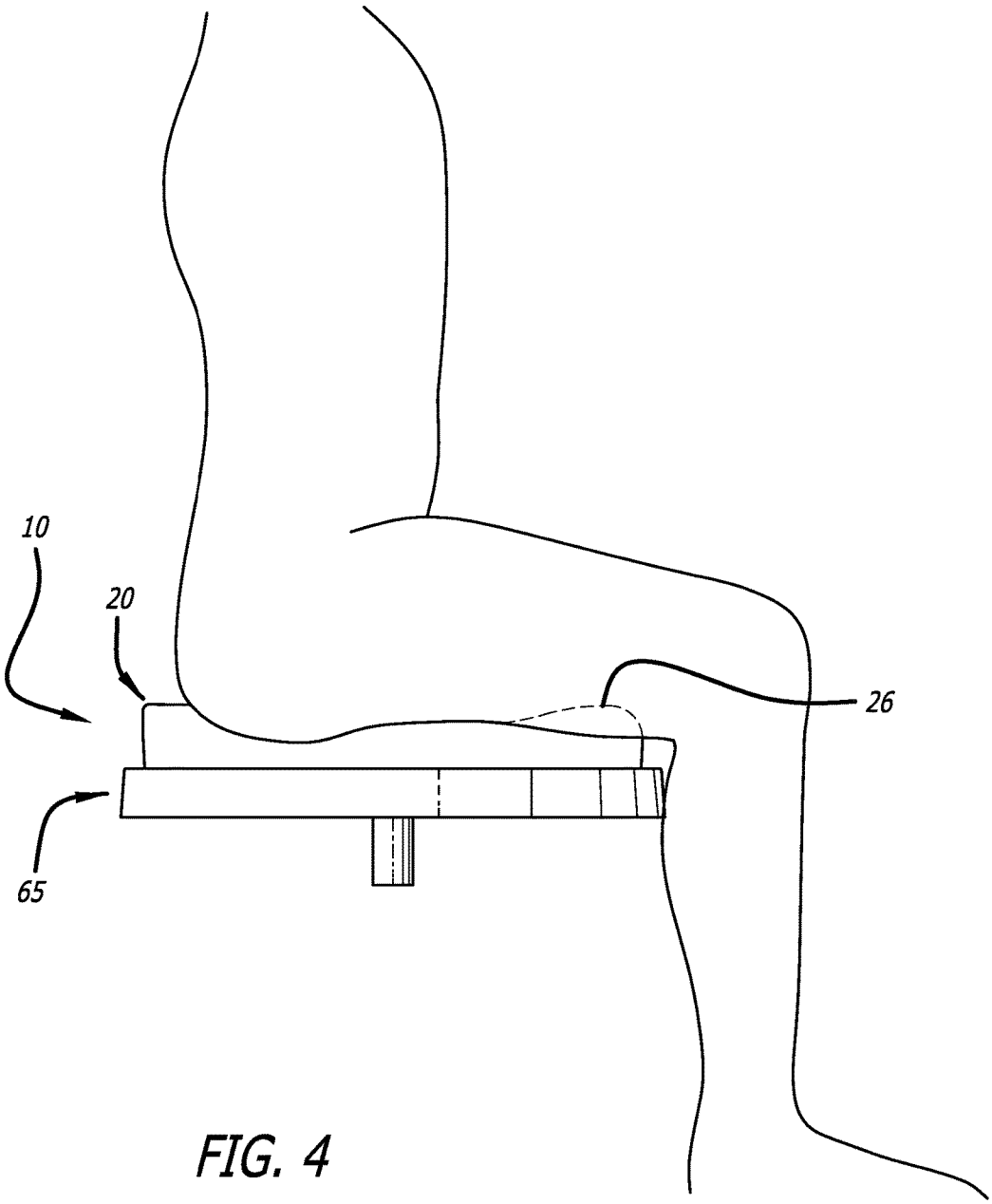
FIG. 4 is a side elevation view of a user seated on the device of FIG. 2.

FIG. 4 is a side elevation view of a user seated on the device of FIG. 3. Raised ridge 26 nestles between the user's thighs thereby helping to keep the user positioned correctly on the cover.

The device 10 can flat as shown, or could be contoured and sloped so as to more evenly spread out the weight of the user across the upper surface of the device, thus minimizing pressure at traditional pressure points while seated.

Cover 20 need not be sold or used in combination with bladder 40. Contoured cover 20 constitutes a separate invention, in addition to the combinations of: cover 20 with bladder 40; bladder 40 with bottom tray 60; or cover 20 with bladder 40 and bottom tray 60.

It will be understood that the terms such "generally," "approximately," "about," and "substantially" as used within the specification and the claims herein allow for a certain amount of variation from any exact dimensions, measurements, and arrangements, and that those terms should be understood within the context of the description and operation of the invention as disclosed herein.

Although the present invention has thus been described in detail with regard to the preferred embodiments and drawings thereof, it should be apparent to those skilled in the art that various adaptations and modifications of the present invention may be accomplished without departing from the spirit and the scope of the invention. Accordingly, it is to be understood that the detailed description and the accompanying drawings as set forth hereinabove are not intended to limit the breadth of the present invention, which should be inferred only from the following claims and their appropriately construed legal equivalents.

I claim:

1. A seating device for increasing use of a user's core muscles while seated, comprising:

a fluid-filled bladder having a generally flat bottom; and a cover over the fluid-filled bladder, the cover matingly engaging the fluid-filled bladder, the cover being stiffer than the fluid-filled bladder, the cover having a contoured top surface in which a recess in the contoured top surface extends generally along a central line of the contoured top surface;

the fluid-filled bladder being filled to a pressure such that when the cover is positioned on the fluid-filled bladder and the user is seated on the cover, the fluid-filled bladder provides a degree of instability to the user seated thereon such that the user must increase use of his core muscles in order to maintain an upright seated position.

2. The seating device of claim 1 wherein:

the contoured top surface of the cover further includes a raised ridge for positioning between the user's legs while seated on the seating device, the raised ridge being positioned along the central line of the contoured top surface;

such that both the recess and the raised ridge are located generally along the central line that extends from a rear of the seating device to a front of the seating device.

3. The seating device of claim 2 wherein:

the recess is dimensioned such that, when the user is a man and is seated on the cover, the depression at least partially receives and accommodates the user's male genitalia.

4. The seating device of claim 2 wherein:

the recess extends from at least a center of the cover to an end of the cover that is opposite the raised ridge.

5. The seating device of claim 1 wherein the cover comprises a resilient cushioning material.

6. The seating device of claim 5 wherein the cover comprises a foam material.

7. The seating device of claim 5 wherein the cover has an Asker C durometer hardness within a range of 30-40.

8. The seating device of claim 1 wherein:

the fluid-filled bladder is disk-shaped and has a diameter of less than eighteen inches;

the cover comprises a stiff resilient material; and the cover has a downwardly extending peripheral lip that extends at least partway down an outer edge of the fluid-filled bladder.

9. The seating device of claim 8 wherein the cover comprises a foam material having an Asker C durometer stiffness in a range of 20-50.

10. The seating device of claim 1 wherein the cover has a peripheral lip that extends at least partway down an outer edge of the fluid-filled bladder and thereby engages and holds the fluid-filled bladder.

11. In combination, the seating device of claim 1 and an exercise machine for exercising in a seated position, and wherein the seating device matingly engages a seat on the exercise machine, the combination increasing use of the user's core muscles while using the exercise machine.

12. The seating device of claim 1 wherein the fluid-filled bladder is inflated to a pressure sufficient to maintain the user's posterior 1-5 cm off a supporting surface on which the fluid-filled bladder is placed.

13. A seating device for increasing use of a user's core muscles while seated, comprising:

a fluid-filled bladder having a generally flat bottom; and a cover over the fluid-filled bladder, the cover matingly engaging the fluid-filled bladder, the cover being stiffer than the fluid-filled bladder;

the fluid-filled bladder being filled to a pressure such that when the cover is positioned on the fluid-flied bladder and the user is seated on the cover, the fluid-filled bladder provides a degree of instability to the user seated thereon such that the user must increase use of his core muscles in order to maintain an upright seated position;

wherein the cover has a raised ridge for positioning between the user's legs in front of the user's abdomen while the user is seated thereon, the raised ridge helping to keep the user positioned correctly on the cover.

14. The seating device of claim 13 wherein the cover comprises:

a generally round body for sitting upon, the generally round body comprising a resilient material; and a peripheral lip extending downwardly from the generally round body extending at least partially around the fluid-filled bladder thereby holding the fluid-filled bladder under the cover;

the generally round body having a recess in a top surface therein, the recess extending generally along a central line of the top surface such that both the recess and the raised ridge are located generally along the central line that extends from a rear of the cover to a front of the cover.

15. The seating device of claim 14 further comprising:

a hook-and-loop fastener for holding the generally round body and the fluid-filled bladder together;

and wherein the generally round body has an Asker C durometer stiffness in a range of 20-50.

16. The seating device of claim 13 further comprising a tray underneath the fluid-filled bladder, the tray having an upwardly extending peripheral lip for receiving and holding the fluid-filled bladder.

17. The seating device of claim 13 further comprising means for securing the seating device to a seat of an abdominal exercise machine.

18. The seating device of claim 13 further comprising a hook-and-loop fastener for holding the cover and fluid-filled bladder together.

19. A seating device for increasing use of a user's core muscles while seated, comprising:

a fluid-filled bladder having a generally flat bottom; and a cover over the fluid-filled bladder, the cover matingly engaging the fluid-filled bladder, the cover being stiffer than the bladder;

the fluid-filled bladder being filled to a pressure such that when the cover is positioned on the fluid-filled bladder and the user is seated on the cover, the fluid-filled bladder provides a degree of instability to the user seated thereon such that the user must increase use of his core muscles in order to maintain an upright seated position;

wherein the cover has a depression therein dimensioned and positioned such that, when the user is a man and is seated on the cover, the depression at least partially receives and accommodates the user's male genitalia.

* * * * *